US005196391A

United States Patent [19]

Ohno et al.

[11] Patent Number: 5,196,391

[45] Date of Patent: * Mar. 23, 1993

[54] SUPPORT FOR DYE TRANSFER TYPE THERMOSENSITIVE PRINTING SHEET

[75] Inventors: Akihiko Ohno; Akira Iwai, both of Ibaraki, Japan

[73] Assignee: Oji Yuka Goseishi Co., Ltd., Tokyo, Japan

[ * ] Notice: The portion of the term of this patent subsequent to Jun. 16, 2009 has been disclaimed.

[21] Appl. No.: 642,776

[22] Filed: Jan. 18, 1991

[30] Foreign Application Priority Data

Jan. 20, 1990 [JP] Japan ..... 2-11249

[51] Int. Cl.[5] ..... B41M 5/20

[52] U.S. Cl. ..... 503/200; 428/319.3; 428/323; 428/332

[58] Field of Search ..... 503/200; 428/323, 332, 428/319.3

[56] References Cited

U.S. PATENT DOCUMENTS 4,996,182 2/1991 Matsui ..... 503/200

FOREIGN PATENT DOCUMENTS 0234563 2/1987 European Pat. Off. .

0283048 3/1988 European Pat. Off. .

0345419 2/1989 European Pat. Off. .

1060490 4/1986 Japan .

*Primary Examiner*—Edith Buffalow

*Attorney, Agent, or Firm*—Sughrue, Mion, Zinn, Macpeak & Seas

[57] ABSTRACT

A support for a dye transfer type thermosensitive printing sheet is disclosed, which comprises a porous film base having a biaxially stretched film of a thermoplastic resin containing an inorganic fine powder having adhered thereon a thermoplastic resin film having a centerline-average roughness of not more than 0.5 μm as a surface layer on which a dye transfer type thermosensitive printing layer is to be provided, said surface layer having a thickness of from 0.3 to 1.5 μm and a Bekk's smoothness of from 2500 to 7000 seconds, and said support having an opacity of not less than 70%, a density of not more than 0.91 g/cm$^3$, and a compression ratio of from 15 to 35% under a stress of 32 kg/cm$^2$. A dye transfer type thermosensitive printing sheet using the support of the invention has excellent surface smoothness and exhibits considerable compressibility and, therefore, shows improved adhesion or contact with a printing head to form an image rich in gradation.

8 Claims, 1 Drawing Sheet

SUPPORT FOR DYE TRANSFER TYPE THERMOSENSITIVE PRINTING SHEET

FIELD OF THE INVENTION

The present invention relates to a support for a dye transfer type thermosensitive printing sheet (dye transfer type thermosensitive image receiving sheet). More particularly, the present invention relates to a dye transfer type thermosensitive printing sheet, comprising a support having thermosensitive printing layers on both sides thereof, that has improved high-speed printability and that provides an image with excellent gradation.

BACKGROUND OF THE INVENTION

A thermosensitive printing process generally includes heating a thermosensitive printing head (hereinafter simply referred to as a head) in accordance with input signals to cause a fusion contact between a color developer and a color former on an image receiving sheet contacted with the head to form a color image. The thermosensitive printing process has a recording speed equal to the quantity of information within a range available on a telephone circuit. The process uses a primary color formation system which does not require development and fixing, and involves little wear of the head. Because of these advantages, the process has been rapidly spreading to applications to information processing equipment, such as printers, facsimile machines, etc.

In order to handle the latest marked increase of information, various printing devices have been developed to date, including the earlier so-called low-speed devices (requiring about 6 minutes for recording a A4-size sheet) and the later high-speed devices (requiring about 1 minute for recording a A4-size sheet). Further, ultrahigh-speed devices realizing higher speed printing have been investigated. With this tendency toward an increased printing speed, various improvements have been made in thermosensitive printing sheets for high speed. One of these improvements, a treatment for smoothing the surface of a thermosensitive printing layer, has been studied as a promising means for ensuring contact between a head and a printing layer and for facilitating heat transfer as described, e.g., in JP-A-59-155094, JP-A-61-69490 and JP-A60-104392 (the term "JP-A" as used herein means an "unexamined published Japanese patent application").

A high-speed printing sheet having a printing layer whose composition is designed so as to have increased thermosensitivity can be treated with various surface smoothing machines integrated into general supercalenders or coaters. Although the surface of the printing layer is highly smoothed, the printing layer suffers from undesired white marks over the entire surface thereof, resulting in a considerable reduction in color developability. As a result, this type of surface treatment has been conducted only to a limited extent sacrificing smoothness to prevent white marks, or the surface treatment has been conducted sacrificing whiteness of the printing layer to achieve smoothness.

*Paper Sales Engineering Series* 4, "Paper for Information Industry", pp. 184–206 edited and published by Shigyo Times (Apr. 10, 1981) reads, generally:

(1) As pulse width increases, developed color density of the thermosensitive printing paper increases and eventually reaches saturation (see FIG. 1).

(2) The color density varies widely at small pulse width.

(3) Speeding up during thermosensitive recording is achieved by making the pulse width narrow.

(4) Since developed color density rises sharply for a temperature difference of 10° to 15° C. in a thermosensitive recording system, it has previously been considered difficult to obtain an image with good gradation. Nevertheless, it was discovered that an intermediate tone could be produced by controlling the period of electricity passage, i.e., the pulse width. Taking this discovery into consideration combined with the market demand for reproduction of an intermediate tone to improve image quality, there is a need to meet this demand by improving the surface properties of thermosensitive recording paper.

With respect to an improvement in surface smoothness of a support of thermosensitive printing paper, it has been proposed to control smoothness of the support before coating a thermosensitive printing layer thereon. For example, JP-B-61-56117 (the term "JP-B" as used herein means an "examined Japanese patent publication") discloses a support having a Bekk's smoothness (JIS P-8119) of at least 500 seconds, and JP-B-1-35751 discloses a support having an optical contact ratio of at least 15%. However, these supports are made of pulp paper, and the highest maximum of Bekk's smoothness attained by calendering is 1200 seconds.

It has been proposed to use synthetic paper comprising a resin containing an inorganic fine powder ("Yupo FPG" produced by Oji Yuka Goseishi Co., Ltd.) in place of pulp paper as a support for dye transfer type thermosensitive printing materials applicable to video color printers, etc. as described in JP-A-62-87390, JP-A-62-148292, and JP-A-63-222891. These synthetic paper supports have a high smoothness of from 800 to 2500 seconds and are capable of providing dye transfer type thermosensitive printing paper excellent in high-speed printability and image density.

The above-described synthetic paper has a degree of whiteness of 90% or more as measured according to JIS (Japanese Industrial Standard) P-8123, a centerline-average roughness (Ra) of from 0.3 to 0.55 μm as measured according to JIS B-0601, and a compression ratio of from 15 to 30% under a stress of 32 kg/cm$^2$, as described in JP-A-63-222891. Being a porous film having a number of fine voids in its base layer formed by stretching, the synthetic paper exhibits excellent cushioning properties so that a thermosensitive printing layer provided thereon has excellent adhesion to a printing head to form an image of high density.

Thermosensitive printing devices underwent rapid improvements in high-speed recording performance, and thus, there is a demand for a dye transfer type thermosensitive printing sheet capable of multiple transfer as described in JP-A-63-222891 that can reproduce gradation of improved color density even at a narrow pulse width.

If the content of an inorganic fine powder in synthetic paper is decreased for the purpose of increasing surface smoothness based on the accepted theory in the art that printed density increases with an increase in smoothness, the volume of voids formed by stretching is reduced to have smaller cushioning effects. As a result, the developed image density is decreased, as demonstrated in Comparative Example 1 of JP-A-63-222891.

SUMMARY OF THE INVENTION

An object of the present invention is to provide a support for a dye transfer type thermosensitive printing sheet, which provides a dye transfer type thermosensitive printing sheet capable of satisfactorily reproducing gradation even using high-speed printing.

The above object of the present invention is accomplished by providing a composite synthetic paper, comprising a biaxially stretched porous film base on which a surface layer comprising a biaxially stretched thin film containing substantially no inorganic fine powder is laminated for improving surface smoothness without impairing cushioning properties thereof.

Particularly, the present invention is directed to a support for a dye transfer type thermosensitive printing sheet comprising a porous film base made of a biaxially stretched film of a thermoplastic resin containing an inorganic fine powder having adhered thereon a thermoplastic resin film having a centerline-average roughness of not more than 0.5 μm as a surface layer on which a dye transfer type thermosensitive printing layer is to be provided, said surface layer having a thickness of from 0.3 to 1.5 μm and a Bekk's smoothness of from 2500 to 7000 seconds, and said support having an opacity of not less than 70%, a density of not more than 0.91 g/cm$^3$, and a compression ratio of from 15 to 35% under a stress of 32 kg/cm$^2$.

DETAILED DESCRIPTION OF THE INVENTION

The support according to the present invention is a thermoplastic resin laminated film having an opacity of not less than 70% as measured according to JIS P-8138 and a degree of whiteness of not less than 85% as measured according to JIS P-8123. A preferred embodiment of the support includes a synthetic resin laminated film comprising a polyolefin biaxially stretched film containing from 15 to 45% by weight of an inorganic fine powder as a base layer having provided thereon a 0.3 to 1.5 μm thick polyolefin biaxially stretched film containing substantially no inorganic fine powder as an outermost surface layer. The surface layer has a centerline-average roughness (Ra) of not more than 0.5 μm as measured according to JIS B-0601, a Bekk's smoothness of from 2500 to 7000 seconds as measured according to JIS P-8119, and a compression ratio of from 15 to 35% under a stress of 32 kg/cm$^2$.

The terminology "substantially no inorganic fine powder" as used herein means that the inorganic fine powder content of the surface layer, if any, is not more than 5% by weight.

Polyolefins which can be used as the resin in the present invention include polyethylene, polypropylene, an ethylene-propylene copolymer, an ethylene-vinyl acetate copolymer, a propylene-butene-1 copolymer, poly(4-methylpentene-1), and polystyrene. Other thermoplastic resins, e.g., polyamide, polyethylene terephthalate, and polybutylene phthalate, can also be employed. From an economical standpoint, polypropylene-based resins are preferred.

Inorganic fine powders which can be used in the present invention include calcium carbonate, calcined clay, diatomaceous earth, talc, titanium oxide, barium sulfate, aluminum sulfate, and silica, each having an average particle size of 10 μm or less. Those having an average particle size of not more than 3 μm are particularly preferred in order for the support to have a centerline-average roughness (Ra) of 0.5 μm or less.

The support of the present invention may contain, in addition to the above-described base layer and the outermost surface layer, other various layers, such as a backing layer comprising pulp paper or polyethylene terephthalate, and a paper-like layer or a back surface layer comprising a uniaxially stretched film of inorganic fine powder-containing polypropylene.

Figure 2:
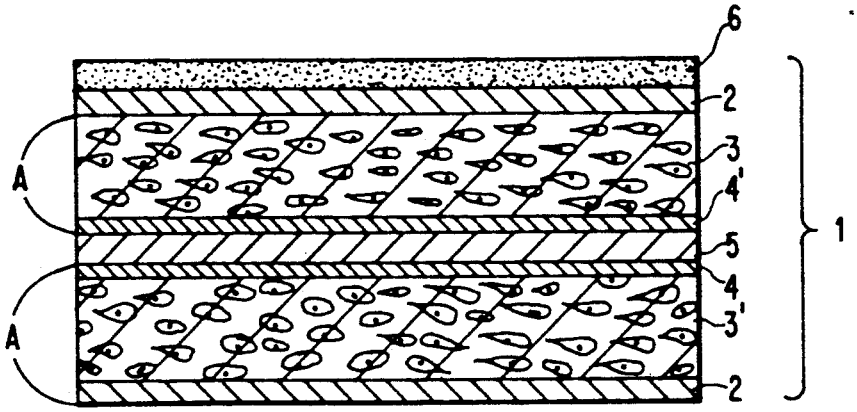
FIG. 2 is a cross section of the support according to one embodiment of the present invention.

The support of the present invention will be illustrated by referring to FIG. 2. In FIG. 2, support 1 comprises a pair of three-layer laminated biaxially stretched films A symmetrically adhered to each other with pulp paper 5 sandwiched inbetween as a backing layer. The three-layer laminated films A each comprises an outermost surface layer 2 made of a biaxially stretched polypropylene film, a base layer 3, 3' made of a biaxially stretched porous polypropylene film containing an inorganic fine powder, and a back surface layer 4, 4' made of biaxially stretched polypropylene film. Dye transfer type thermosensitive printing layer 6 is provided on one of the outermost surface layers 2 of support 1 to obtain dye transfer type thermosensitive printing sheet.

If the outermost surface layer 2 is too thick, the Bekk's smoothness is improved, the void (porosity) of the support is decreased to reduce compressibility, and the resulting recording sheet has a reduced color density. On the contrary, if the thickness of the outermost surface layer 2 is less than 0.3 μm, the Bekk's smoothness of the outermost surface layer 2 is reduced due to the influence of the inorganic fine powder projected on the surface of the base layer 3, which makes color gradation less perceptible when the pulse width is narrow in high-speed printing.

The Bekk's smoothness of the outermost surface layer should be 2500 seconds or more, and preferably 3600 seconds or more. The higher the Bekk's smoothness, the higher the developed color density, which makes high-speed printing feasible. However, since too high a Bekk's smoothness sometimes causes sticking, resulting in a reduction in color density, the upper limit of the Bekk's smoothness is 7000 seconds.

The support has an opacity of 70% or more. The higher the opacity, the higher the image contrast, making the image more perceptible. The density and compressibility of the support are correlated so that as the volume of microvoids increases, the density decreases, and the compressibility increases. The void of the support ranges from 18 to 55%. The void (v) can be obtained from a density of a film before stretching ($\rho_0$) and a density of the film after stretching ($\rho$) according to the following equation.

$$v = \frac{\rho_0 - \rho}{\rho_0} \times 100(\%)$$

As the density (JIS P-8118) of the support decreases or as the compressibility of the support increases, contact between the dye transfer type thermosensitive printing sheet and a head is improved, and a higher color density can be obtained.

The support of the present invention can be obtained by melt-kneading a thermoplastic resin containing 0 to 5% by weight of an inorganic fine powder and a thermoplastic resin containing 15 to 45% by weight of an inorganic fine powder in a separate extruder, feeding these thermoplastic resins to the same die where they are laminated in a molten state, co-extruding the laminate from the die, cooling the extruded laminate to a temperature lower than the melting point of the thermoplastic resins by 30° to 100° C., reheating the laminate to a temperature in the vicinity of the melting point of the thermoplastic resins, and biaxially stretching the laminate in the longitudinal direction (machine direction) at a stretch ratio of from 3 to 8 and in the lateral direction (cross direction) at a stretch ratio of from 3 to 12 either simultaneously or successively.

A dye transfer type thermosensitive printing layer is then provided on the surface of the support to obtain a dye transfer type thermosensitive printing sheet. Materials forming the dye transfer type thermosensitive printing layer include those exhibiting satisfactory heat transfer properties for heat-fusible color formers containing a pigment. Such materials include high polymers, such as acrylic resins and polyolefin resins. Resins exhibiting dyeability with subliming or vaporizing dyes, such as high polymers, e.g., polyesters, and active clay, are also employed. Acrylic resins are particularly preferred. Specific examples of dye transfer type thermosensitive printing layer-forming materials include (a) an acrylic copolymer resin, (b) a mixture of (1) an acrylic copolymer resin, (2) an amino compound having an amino group, and (3) an epoxy compound, and (c) a mixture of (a) or (b) and an organic or inorganic filler.

Monomers as an ingredient in the acrylic copolymer resins include dimethylaminoethyl methacrylate, diethylaminoethyl methacrylate, dibutylaminoethyl acrylate, dimethylaminoethyl acrylamide, diethylaminoethyl methacrylamide, and dimethylaminoethyl methacrylamide.

Other vinyl monomers as an ingredient in the acrylic copolymer resins include styrene, methyl methacrylate, ethyl acrylate, n-butyl acrylate, t-butyl acrylate, ethyl methacrylate, vinyl chloride, ethylene, acrylic acid, methacrylic acid, itaconic acid, acrylonitrile, and methacrylamide.

Amino compounds as component (b) include polyalkylenepolyamines, e.g., diethylenetriamine and triethylenetetramine, polyethyleneimine, ethyleneurea, an epichlorohydrin adduct of polyaminepolyamide (e.g., "Kymene-557H" produced by Dick-Hercules, "AF-100" produced by Arakawa Rinsan Kagaku Kogyo K.K.), and an aromatic glycidyl ether or ester adduct of polyamine-polyamide (e.g., "Sanmide 352", "Sanmide 351" and "X-2300-75" produced by Sanwa Kagaku K.K., "Epicure-3255" produced by Shell Kagaku K.K.).

Epoxy compounds as component (b) include bisphenol A diglycidyl ether, bisphenol F diglycidyl ether, phthalic acid diglycidyl ester, polypropylene glycol diglycidyl ether, and trimethylolpropane triglycidyl ether.

Inorganic fillers as component (c) include synthetic silica (e.g., white carbon) and inorganic pigments, e.g., calcium carbonate, clay, talc, aluminum sulfate, titanium dioxide, and zinc oxide, each having an average particle size of not more than 0.5 μm. Preferred of them are synthetic silica (e.g., white carbon) and calcium carbonate having an average particle size of not more than 0.2 μm.

Organic fillers as component (c) include fine particles of various high polymers preferably having a particle diameter of not more than 10 μm. The high polymers include methyl cellulose, ethyl cellulose, polystyrene, polyurethane, ureaformalin resins, melamine resins, phenol resins, iso-(or diiso-)butylene/maleic anhydride copolymers, styrene/maleic anhydride copolymers, polyvinyl acetate, polyvinyl chloride, vinyl chloride/vinyl acetate copolymers, polyesters, polyacrylic esters, polymethacrylic esters, and styrene/butadiene/acrylate copolymers.

In particular, the inorganic filler may be subjected to surface treatment with a nonionic, cationic or amphoteric surface active agent, e.g., sulfonated oils, sodium dodecylsulfate, organic amines, metallic soaps, and sodium lignin sulfonate, so as to have improved wettability by inks of the dye transfer type thermosensitive printing sheet.

These fillers are usually used in a proportion of not more than 30% by weight.

The thermosensitive printing layer-forming material is coated on the outermost surface layer of the support by means of a general coating machine, e.g., a blade coater, an air knife coater, a roll coater, and a bar coater, a size press, a gate roll machine, etc. and dried to form a thermosensitive printing layer having a thickness of from 0.2 to 20 μm, and preferably from 0.5 to 10 μm.

If desired, the resulting thermosensitive printing sheet may be subjected to calendering to further improve surface smoothness.

The present invention is now illustrated in greater detail with reference to Examples, but it should be understood that the present invention is not limited thereto. All the percents, parts, and ratios are given by weight unless otherwise indicated.

Compression ratio and surface roughness of the supports obtained were measured as follows.

Compression ratio:

$$\text{Compression Ratio} = (t_0 - t_1)/t_0 \times 100$$

wherein $t_0$ is a thickness (μm) of a specimen, and $t_1$ is a thickness (μm) of a specimen when compressed under a load of 32 kg/cm$^2$.

Centerline-Average Roughness (Ra):

Surface roughness was measured by using a three-dimensional roughness meter ("SE-3AK" manufactured by Kosaka Kenkyusho) and an analyzer ("Model SPA-11" manufactured by Kosaka Kenkyusho) to obtain an average.

EXAMPLE 1

Composition (A) comprising 97% of polypropylene having a melt index (MI) of 4 g/10 min and a melting point between 164° C. and 167° C. and 3% of ground calcium carbonate having an average particle size of 1.5 μm, composition (B) comprising 85% of polypropylene having an MI of 0.8 g/10 min, 5% of high-density polyethylene, and 10% of calcium carbonate having an average particle size of 1.5 μm, and composition (C) comprising 97% of polypropylene having an MI of 4 g/10 min and 3% of calcium carbonate having an average particle size of 1.5 μm were separately melt-kneaded at 260° C. in a respective extruder, supplied to the same die where they were melt-laminated, and co-extruded from the die at 250° C. The extruded laminate was cooled to about 60° C. by means of cooling rolls.

The laminate was heated to 145° C., and then longitudinally stretched at a stretch ratio of 5 by making use of a difference of peripheral speed among a number of rolls. After heating to about 162° C., the laminate was reheated to 162° C. in a tenter and then laterally stretched at a stretch ratio of 8.5 by means of the tenter, followed by annealing at 165° C. The laminate was cooled to 60° C. and trimmed to obtain a synthetic paper web (support) having a three-layer structure (A/B/C=0.5 μm/59 μm/0.5 μm).

The resulting synthetic paper had a density of 0.70 g/cm$^3$, an opacity of 75%, a void of 30%, and a degree of whiteness of 96%. The outermost surface layer A had a Bokk's smoothness of 3000 seconds, a centerline-average roughness (Ra) of 0.44 μm, and a gloss of 75% (75°).

EXAMPLES 2 TO 8 AND COMPARATIVE EXAMPLES 1 TO 4

Synthetic paper was produced in the same manner as in Example 1, except for changing the formation of compositions (A), (B), and (C) as shown in Table 1 below and changing the die gap to change the thickness of each layer as shown in Table 1. Physical properties of the resulting synthetic paper are shown in Table 1.

COMPARATIVE EXAMPLE 5

Composition (B) comprising 85% of polypropylene having an MI of 0.8 g/10 min, 5% of high-density polyethylene, and 10% of ground calcium carbonate having an average particle size of 1.5 μm was extruded by means of an extruder at 250° C. to obtain a sheet. The extruded sheet was cooled to about 60° C. by means of cooling rolls.

The sheet was heated to 150° C. and longitudinally stretched at a stretch ratio of 5 by making use of a difference in peripheral speed of a number of rolls. The sheet was heated to about 162° C., reheated to 162° C. in a tenter, and then laterally stretched at a stretch ratio of 7.5 by means of the tenter, followed by annealing at 165° C. After cooling to 60° C., the laminate was trimmed to obtain a biaxially stretched film having a thickness of 60 μm.

COMPARATIVE EXAMPLE 6

A biaxially stretched film was produced in the same manner as in Comparative Example 5, except for using composition (B) comprising 87% of polypropylene, 10% of high-density polyethylene, and 3% of ground calcium carbonate.

EXAMPLE 9

Synthetic paper having a three-layer structure was produced in the same manner as in Example 1, except for replacing the ground calcium carbonate with calcined clay having an average particle size of 0.8 μm.

COMPARATIVE EXAMPLE 7

Composition (C) comprising 79% of polypropylene having an MI of 0.8 g/10 min, 5% of high-density polyethylene, and 16% of calcium carbonate having an average particle size of 1.5 μm was kneaded in an extruder at 270° C. and extruded into a sheet, followed by cooling by means of cooling rolls. The extruded sheet was heated to 140° C. and longitudinally stretched at a stretch ratio of 5.

Composition (A) comprising 45% of polypropylene having an MI of 4.0 g/10 min and 55% of calcium carbonate having an average particle size of 1.0 μm and composition (B) comprising 55% of polypropylene having an MI of 4.0 g/10 min and 45% of calcium carbonate having an average particle size of 1.5 μm were separately melt-kneaded in a respective extruder, laminated in a die, and co-extruded into a sheet. The extruded sheet was laminated on one side of the above-prepared stretched sheet with composition (A) as an outer layer. Composition (B) was melt-kneaded in a separate extruded and extrusion-laminated on the other side of the stretched sheet. The resulting laminated sheet was cooled to 60° C., reheated to 162° C., and laterally stretched at a stretch ratio of 7.5 by means of a tenter, followed by annealing at 165° C. After cooling to 60° C., the laminated sheet was trimmed to obtain synthetic paper having a four-layer structure (A/B/C/B=2 μm/33 μm/70 μm/35 μm).

The outermost layer A of the synthetic paper had a Bekk's smoothness of 800 seconds, an Ra of 0.45 μm, and a composition ratio of 24%. The synthetic paper as a whole had a degree of whiteness of 95.6%.

COMPARATIVE EXAMPLE 8

Synthetic paper was produced in the same manner as in Comparative Example 7, except for using polypropylene having an MI of 4.0 g/10 min as composition (A) for the outermost layer and changing the thickness of each layer as shown in Table 1. Physical properties of the resulting synthetic paper are shown in Table 1.

APPLICATION EXAMPLE 1

A coating composition having the following formulation was coated on the outermost surface layer A (or layer B in the case of monolayer stretched film) of each of the synthetic paper sheets (supports) obtained in Examples 1 to 9 and Comparative Examples 1 to 8 at a spread of about 1 g/m$^2$ (on a solid basis) and dried at 80° C. for 30 seconds to obtain a dye transfer type thermosensitive printing sheet comprising the support having formed thereon an about 1 μm thick thermosensitive printing layer.

| Coating Composition: | |
|---|---|
| Cationic acrylic copolymer emulsion (solid content: 50%) | 200 parts |
| Polyethyleneimine ("Epomine SP-018" produced by Nippon Shokubai Kagaku Kogyo Co., Ltd.) | 6 parts |
| Bisphenol A diglycidyl ether ("Epikote 828" produced by Yuka Shell Epoxy Kagaku K.K.; epoxy equivalent: 187) | 20 parts |

Figure 1:
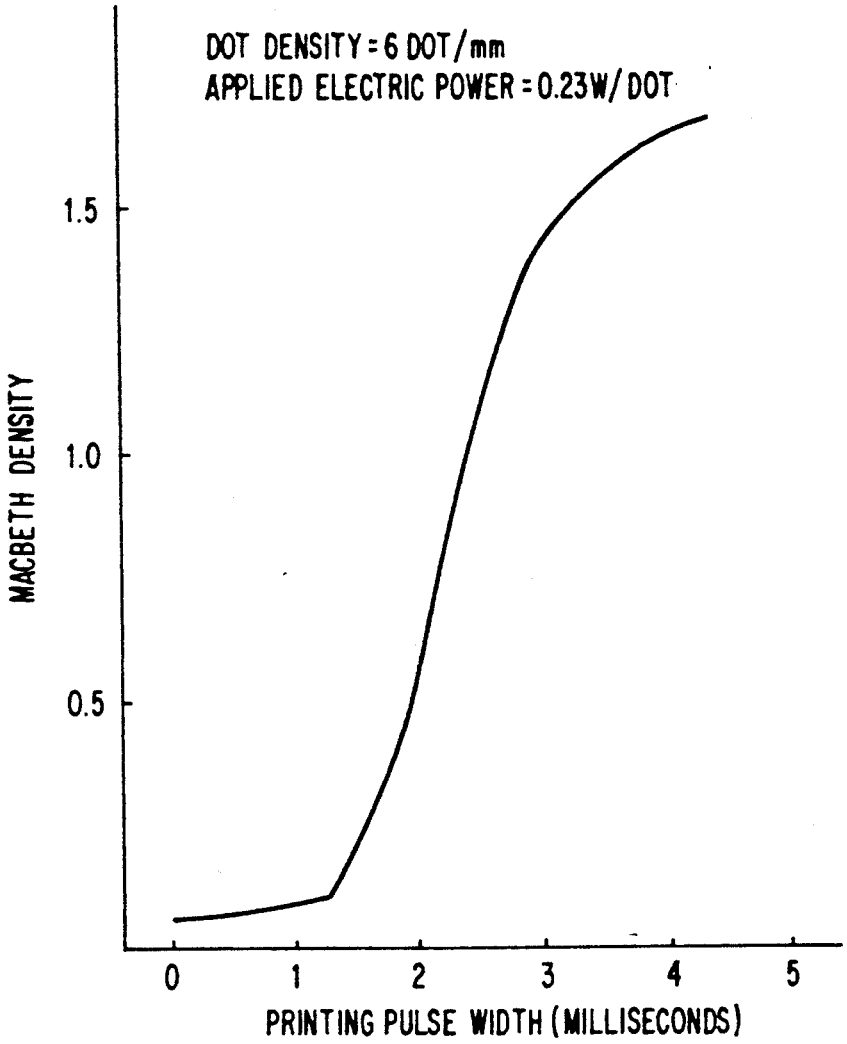
FIG. 1 is a graph showing the relationship between the pulse width of a recording head and the Macbeth density of an image printed on a dye transfer type thermosensitive printing sheet.

The dye transfer type thermosensitive printing sheet was printed by using a printer produced by Ohkura Denki K.K. (dot density: 6 dot/mm; applied electric power: 0.23 W/dot) while varying the printing pulse width, and the Macbeth density of the resulting image was measured to obtain density vs. pulse width plots as shown in FIG. 1. The Macbeth density (highlight) at a pulse width of 1.3 milliseconds is shown in Table 2 below.

Further, the gradation of the image was evaluated visually according to the following rating system. The results of the evaluation are shown in Table 2.

| | |
|---|---|
| 5 | Very good |
| 4 | Good |
| 3 | Not a problem for practical use |
| 2 | Interferes with practical use |
| 1 | Poor |

TABLE 2-continued

| Example No. | Macbeth Density*1 | Gradation |
|---|---|---|
| Example 3 | 0.21 | 5 |
| Example 4 | 0.21 | 5 |
| Example 5 | 0.22 | 5 |
| Example 6 | 0.21 | 5 |

TABLE 1

| Example No. | Layer A PP*1 (wt %) | Layer A $CaCO_3$ (wt %) | Layer B PP (wt %) | Layer B HDPE*2 (wt %) | Layer B $CaCO_3$ (wt %) | Layer C PP (wt %) | Layer C $CaCO_3$ (wt %) | Thickness (A/B/C) (μm) |
|---|---|---|---|---|---|---|---|---|
| Example 1 | 97 | 3 | 85 | 5 | 10 | 97 | 3 | 0.5/59/0.5 |
| Example 2 | 97 | 3 | 85 | 5 | 10 | 97 | 3 | 1.0/58/1.0 |
| Example 3 | 97 | 3 | 85 | 5 | 10 | 55 | 45 | 1.0/58/1.0 |
| Example 4 | 97 | 3 | 85 | 5 | 10 | — | — | 1.0/59/— |
| Example 5 | 97 | 3 | 85 | 5 | 10 | 97 | 3 | 1.0/148/1.0 |
| Example 6 | 97 | 3 | 65 | 10 | 25 | 97 | 3 | 1.0/58/1.0 |
| Example 7 | 97 | 3 | 85 | 5 | 10 | 97 | 3 | 1.5/57/1.5 |
| Example 8 | 95 | 5 | 85 | 5 | 10 | 97 | 3 | 1.0/58/1.0 |
| Example 9 | 97 | 3 (clay) | 85 | 5 | 10 (clay) | 97 | 3 (clay) | 0.5/59/0.5 |
| Comparative Example 1 | 100 | — | 85 | 5 | 10 | 97 | 3 | 1.5/57/1.5 |
| Comparative Example 2 | 85 | 15 | 85 | 5 | 10 | 97 | 3 | 1.0/58/1.0 |
| Comparative Example 5 | — | — | 85 | 5 | 10 | — | — | —/60/— |
| Comparative Example 3 | 97 | 3 | 90 | 5 | 5 | 97 | 3 | 1.0/58/1.0 |
| Comparative Example 4 | 97 | 3 | 85 | 5 | 10 | 97 | 3 | 15/30/15 |
| Comparative Example 6 | — | — | 97 | — | 3 | — | — | —/60/— |
| Comparative Example 7 | Example 1 of JP-A-63-222891 | | | | | | | 2/33/70/35*3 |
| Comparative Example 8 | Comparative Example 1 of JP-A-63-222891 | | | | | | | 10/25/75/35*3 |

| Example No. | Physical Properties of Layer A: Smoothness (sec) | Ra (μm) | Gloss (%) | Opacity (%) | Void (%) | Compression Ratio (%) | Density (g/cm³) |
|---|---|---|---|---|---|---|---|
| Example 1 | 3000 | 0.44 | 75 | 75 | 30 | 27 | 0.67 |
| Example 2 | 4500 | 0.39 | 86 | 75 | 29 | 26 | 0.68 |
| Example 3 | 4500 | 0.39 | 87 | 77 | 30 | 26 | 0.67 |
| Example 4 | 4500 | 0.39 | 87 | 75 | 29 | 26 | 0.68 |
| Example 5 | 4300 | 0.40 | 87 | 80 | 33 | 28 | 0.64 |
| Example 6 | 4450 | 0.44 | 86 | 85 | 45 | 32 | 0.59 |
| Example 7 | 6000 | 0.32 | 90 | 76 | 29 | 25 | 0.68 |
| Example 8 | 2800 | 0.50 | 69 | 75 | 30 | 23 | 0.67 |
| Example 9 | 2750 | 0.48 | 73 | 75 | 31 | 27 | 0.66 |
| Comparative Example 1 | 10000 | 0.20 | 92 | 70 | 30 | 20 | 0.67 |
| Comparative Example 2 | 900 | 0.65 | 62 | 79 | 20 | 26 | 0.77 |
| Comparative Example 5 | 1500 | 0.58 | 60 | 77 | 30 | 30 | 0.67 |
| Comparative Example 3 | 2800 | 0.37 | 85 | 45 | 14 | 11 | 0.82 |
| Comparative Example 4 | 4200 | 0.45 | 74 | 50 | 26 | 12 | 0.70 |
| Comparative Example 6 | 8500 | 0.24 | 86 | 36 | 8 | 10 | 0.85 |
| Comparative Example 7 | 800 | 0.45 | 85 | 88 | 31 | 24 | 0.76 |
| Comparative Example 8 | 5000 | 0.22 | 92 | 80 | 18 | 18 | 0.87 |

Note:
*1Polypropylene
*2High-density polyethylene
*3A/B/C/B

TABLE 2

| Example No. | Macbeth Density*1 | Gradation |
|---|---|---|
| Example 1 | 0.20 | 5 |
| Example 2 | 0.21 | 5 |
| Example 7 | 0.22 | 4 |
| Example 8 | 0.20 | 4 |
| Example 9 | 0.20 | 4 |
| Comparative Example 1 | 0.13 | 2 |
| Comparative Example 2 | 0.09 | 2 |

TABLE 2-continued

| Example No | Macbeth Density*1 | Gradation |
|---|---|---|
| Comparative Example 5 | 0.13 | 2 |
| Comparative Example 3 | 0.10 | 1 |
| Comparative Example 4 | 0.12 | 1 |
| Comparative Example 6 | 0.13 | 2 |
| Comparative Example 7 | 0.09 | 2 |
| Comparative Example 8 | 0.13 | 2 |

Note: *1Pulse width: 1.3 mm

APPLICATION EXAMPLE 2

The synthetic paper sheet obtained in Example 2 was adhered to both sides of a 60 μm thick fine paper sheet with an adhesive with the layer A as the outside layer to obtain a support having a multi-layer structure of A/B/C/fine paper/C/B/A (density: 0.85 g/cm$^3$).

A thermosensitive printing layer was provided on one side of the support (on the layer A) in the same manner as in Application Example 1 to prepare a dye transfer type thermosensitive printing sheet. Thermosensitive printing was carried out on the resulting dye transfer type thermosensitive printing sheet in the same manner as in Application Example 1. As a result, an image having satisfactory density (Macbeth density: 0.21) and gradation (rate 5) was obtained.

APPLICATION EXAMPLE 3

The support obtained in Example 3 was adhered to both sides of a 60 μm thick fine pulp paper sheet with an adhesive to obtain a support having a multi-layer structure of A/B/C/fine pulp paper/A/B/C (density: 0.85 g/cm$^3$).

A thermosensitive printing layer was provided on the layer A of the support in the same manner as in Application Example 1 to prepare a dye transfer type thermosensitive printing sheet, and thermosensitive printing was carried out in the same manner as in Application Example 1. As a result, an image having satisfactory density (Macbeth density: 0.21) and gradation (rate 5) was obtained.

As described in the above examples, the support according to the present invention provides a dye transfer type thermosensitive printing sheet which is excellent in surface smoothness and exhibits considerable compressibility due to the numerous microvoids of the support. Therefore, the recording sheet shows improved adhesion or contact with a printing head to form an image rich in gradation.

While the invention has been described in detail and with reference to specific examples thereof, it will be apparent to one skilled in the art that various changes and modifications can be made therein without departing from the spirit and scope thereof.

What is claimed is:

1. A support for a dye transfer thermosensitive printing sheet comprising a porous film base having a biaxially stretched film of a thermoplastic resin containing an inorganic fine powder having adhered thereon a thermoplastic resin film having a centerline-average roughness of not more than 0.5 μm as a surface layer on which a dye transfer thermosensitive printing layer is to be provided, said surface layer having a thickness of from 0.3 to 1.5 μm and a Bekk's smoothness of from 2500 to 7000 seconds, and said support having an opacity of not less than 70%, a density of not more than 0.91 g/cm$^3$, and a compression ratio of from 15 to 35% under a stress of 32 kg/cm$^2$.

2. A support as in claim 1, wherein the degree of whiteness is not less than 85%.

3. A support as in claim 1, wherein the biaxially stretched film comprises polyolefin and 15 to 45% by weight inorganic fine powder.

4. A support as in claim 3, wherein the polyolefin biaxially stretched film contains substantially no inorganic fine powder as an outermost surface layer.

5. A support as in claim 1, wherein the average particle size of the inorganic fine powder is not more than 3 μm.

6. A support as in claim 1, wherein the dye transfer thermosensitive printing layer has a thickness of from 0.2 to 20 μm.

7. A support as in claim 1, wherein the dye transfer thermosensitive printing layer has a thickness of from 0.5 to 10 μm.

8. A support as in claim 1, wherein the surface layer has a Bekk's smoothness of from 3600 to 7000 seconds.

* * * * *